US010724303B2

(12) United States Patent
Eddison

(10) Patent No.: US 10,724,303 B2
(45) Date of Patent: Jul. 28, 2020

(54) DOWNHOLE VIBRATION ASSEMBLY AND METHOD OF USING SAME

(71) Applicant: NOV DOWNHOLE EURASIA LIMITED, Gloucestershire (GB)

(72) Inventor: Alan Martyn Eddison, York (GB)

(73) Assignee: NOV Downhole Eurasia Limited (GB)

( * ) Notice: Subject to any disclaimer, the term of this patent is extended or adjusted under 35 U.S.C. 154(b) by 385 days.

(21) Appl. No.: 15/521,050

(22) PCT Filed: Oct. 16, 2015

(86) PCT No.: PCT/IB2015/002165

§ 371 (c)(1),
(2) Date: Apr. 21, 2017

(87) PCT Pub. No.: WO2016/063131

PCT Pub. Date: Apr. 28, 2016

(65) Prior Publication Data

US 2017/0335631 A1 Nov. 23, 2017

Related U.S. Application Data

(60) Provisional application No. 62/066,846, filed on Oct. 21, 2014.

(51) Int. Cl.
*E21B 10/32* (2006.01)
*E21B 28/00* (2006.01)
(Continued)

(52) U.S. Cl.
CPC ..... *E21B 10/322* (2013.01); *E21B 7/24* (2013.01); *E21B 7/28* (2013.01); *E21B 28/00* (2013.01)

(58) Field of Classification Search
CPC ..... E21B 10/32; E21B 10/322; E21B 10/325; E21B 28/00; E21B 7/24; E21B 7/28; E21B 43/003; E21B 4/02
(Continued)

(56) References Cited

U.S. PATENT DOCUMENTS 1,720,942 A * 7/1929 Campbell ..... E21B 10/34 175/273
2007/0163809 A1* 7/2007 Mackay ..... E21B 10/322 175/57
(Continued)

OTHER PUBLICATIONS

Merriam-Webster definition of Cam https://www.merriam-webster.com/dictionary/cam (Year: 2019).*
(Continued)

*Primary Examiner* — David Carroll
(74) *Attorney, Agent, or Firm* — Conley Rose, P.C.

(57) ABSTRACT

A vibration assembly of a drilling tool for drilling a wellbore penetrating a subterranean formation is disclosed. The downhole drilling tool includes a drill string, a bottomhole assembly and a drill bit. The vibration assembly includes a housing (334*a*) operatively connectable to the bottomhole assembly, expanders (122) positionable in the housing and radially extendable and retractable thereabout, and a radial vibrator (comprising mandrel (446), enlarger spring (48), cam portion (458) and vibration spring (570) operatively connectable to the expanders to vibrationally move the expanders against the wall of the wellbore whereby movement of the downhole tool is altered during drilling.

20 Claims, 13 Drawing Sheets

(51) Int. Cl.
*E21B 7/24* (2006.01)
*E21B 7/28* (2006.01)

(58) Field of Classification Search
USPC ..... 166/177.6
See application file for complete search history.

(56) References Cited

U.S. PATENT DOCUMENTS

| | | | | |
|---|---|---|---|---|
| 2010/0089583 | A1* | 4/2010 | Xu | E21B 10/322 166/298 |
| 2010/0224412 | A1 | 9/2010 | Allahar | |
| 2011/0127044 | A1 | 6/2011 | Radford et al. | |
| 2013/0199848 | A1 | 8/2013 | Gust | |
| 2014/0041943 | A1 | 2/2014 | Lanning et al. | |
| 2014/0251687 | A1 | 9/2014 | McKay | |

OTHER PUBLICATIONS

The American Heritage Dictionary definition of cam https://ahdictionary.com/word/search.html?q=cam (Year: 2019).*
International Search Report and Written Opinion dated Feb. 29, 2016, for International Patent Application No. PCT/IB2015/002165 (14 p.).

* cited by examiner

DOWNHOLE VIBRATION ASSEMBLY AND METHOD OF USING SAME

CROSS-REFERENCE TO RELATED APPLICATIONS

This application is a 35 U.S.C. 371 national stage application of PCT/IB2015/002165 filed Oct. 16, 2015 entitled "Downhole Vibration. Assembly and Method of Using Same," which claims benefit of provisional application No. 62/066,846 filed Oct. 21, 2014, both of which are incorporated herein by reference in their entirety for all purposes.

BACKGROUND

This present disclosure relates generally to techniques for performing wellsite operations. More specifically, the present disclosure relates to downhole equipment, such as drilling and/or hole enlarging tools.

Oilfield operations may be performed to locate and gather valuable downhole fluids. Oil rigs are positioned at wellsites and downhole equipment, such as a drilling tool, is deployed into the ground by a drill string to reach subsurface reservoirs. At the surface, an oil rig is provided to deploy stands of pipe into the wellbore to form the drill string. Various surface equipment, such as a top drive, a Kelly and a rotating table, may be used to apply torque to the stands of pipe and threadedly connect the stands of pipe together. A drill bit is mounted on the downhole end of the drill string, and advanced into the earth from the surface to form a wellbore.

The drill string may be provided with various downhole components, such as a bottomhole assembly (BHA), measurement while drilling, logging while drilling, telemetry and other drilling tools, to perform various downhole operations, such as providing power to the drill bit to drill the wellbore and performing downhole measurements.

The bit may be advanced into the earth to form the wellbore. The drilling tool may also be provided with a reamer to assist in enlarging the wellbore during drilling. Examples of reamers are provided in U.S. Pat./Application Nos. 2010/0181115, 2012/0055714, U.S. Pat. Nos. 8,307,921, 7,823,663, 7,703,553, 7,958,953, 6,279,670, and 6,615,933, the entire contents of which are hereby incorporate by reference herein.

SUMMARY

In at least one aspect, the disclosure relates to a vibration assembly of a drilling tool for drilling a wellbore penetrating a subterranean formation. The downhole drilling tool comprising a drill string, a bottomhole assembly and a drill bit. The vibration assembly includes a housing operatively connectable to the bottomhole assembly, expanders positionable in the housing and radially extendable and retractable thereabout, and a radial vibrator operatively connectable to the expanders to vibrationally move the expanders against the wall of the wellbore whereby movement of the downhole tool is altered during drilling.

The radial vibrator may include hydraulics, an electronic power supply, and/or a mechanical actuator. The radial vibrator may include a mandrel slidably positionable in the housing. The mandrel may have a cam surface thereon to engage the expanders as the mandrel moves about the housing whereby the expanders are radially extendable and retractable thereabout. The vibration assembly may also include a vibration spring operatively connectable to the mandrel to generate pulsing movement thereof. The vibration spring may be positioned between the mandrel and the housing. The vibration spring may be a Bellville spring. The vibration assembly may also include a mandrel spring thereabout to urge the mandrel to a retracted position and/or seals between the mandrel and the housing.

The mandrel may comprise a cam portion having the cam surface thereon, a spring portion having the mandrel spring thereabout, and a housing portion slidingly supported in the housing. The housing may comprise one of a drill collar, a drill pipe, a stabilizer, and a drill bit. The expanders may be positioned in the bottomhole assembly and/or the drill bit. The expanders may be cutting blocks and/or pads. The expanders may be extendable about the housing to centralize the bottomhole assembly in the wellbore.

In another aspect, the disclosure relates to a drilling system for drilling a wellbore penetrating a subterranean formation. The drilling system may include a downhole drilling tool and a vibration assembly. The downhole drilling tool may comprise a drill string, a bottomhole assembly and a drill bit. The vibration assembly operatively may be connectable to the downhole drilling tool. The vibration assembly may comprise a housing operatively connectable to the bottomhole assembly, expanders positionable in the housing and radially extendable and retractable thereabout, and a radial vibrator operatively connectable to the expanders to vibrationally move the expanders against the wall of the wellbore whereby movement of the downhole tool is altered during drilling.

The drilling system may comprise an axial assembly operatively connectable to the bottomhole assembly. The axial assembly may comprise at least one pulser, a shock tool, and/or hole enlarger. The pulser may be downhole from the hole enlarger. The pulser may comprise a valve and nozzles. The shock tool may be above the hole enlarger, below the pulser, and/or between the hole expander and the pulser. The hole enlarger may comprise a reamer, and/or an under reamer. The drilling system may also comprise at least one controller.

In yet another aspect, the disclosure relates to a method of drilling a wellbore penetrating a subterranean formation. The method involves advancing a drilling tool into the formation. The drilling tool comprises a drill string, a bottomhole assembly, a drill bit, and a vibration assembly. The vibration assembly comprises expanders. The method further involves vibrating the expanders against a wall of the wellbore by repeatedly extending and retracting the expanders from the bottomhole assembly during drilling.

The method may also involve expanding the wellbore with a hole opener, applying fluid to a wall of the wellbore before the expanding, axially pulsing and axially shocking the bottomhole assembly, axially pulsing the bottomhole assembly, and/or axially shocking the bottomhole assembly.

The vibrating may comprise selectively extending the expanders by slidingly positioning a mandrel in the housing and into selective engagement with the expanders; offsetting at least one of stick slip, vibration, and whirl of the drilling tool; repeatedly extending the expanders from the bottomhole assembly; and/or repeatedly extending the expanders from the bit. The method may also involve applying one of tension, compression and combinations thereof to the bottomhole assembly.

Finally, in another aspect, the disclosure relates to a vibration assembly for drilling a wellbore penetrating a subterranean formation. The vibration assembly is carried by a downhole drilling tool comprising a drill string, a bottomhole assembly and a drill bit. The vibration assembly comprises at least one shock tool positionable in the bottomhole assembly to convert pressure pulses into mechanical vibration (the shock tool comprises a spring loaded mandrel), an axial pulser positionable in the bottomhole assembly (the pulser comprising a valve to generate pressure pulses of the fluid passing therethrough), and a vibration assembly positionable in the bottomhole assembly and operatively connectable to the shock tool and the pulser uphole from the pulser. The vibration assembly comprises expanders radially extendable therefrom whereby radial pulses are generated about the drilling tool during drilling.

The vibration assembly may comprise a reamer housing and expanders positionable in the reamer housing and selectively extendable therefrom. The shock tool may be positioned at one of uphole from the vibration assembly and downhole from the vibration assembly. The at least one shock tool may be positioned at one of uphole from the pulser and/or downhole from the pulser. The vibration assembly may comprise a reamer, a hole enlarger and/or an under reamer. The vibration assembly may form part of a bottomhole assembly with a drill bit at an end thereof and having fluid passing therethrough. The vibration assembly may also comprise a downhole unit positionable in communication with a surface unit.

BRIEF DESCRIPTION OF THE DRAWINGS

So that the present disclosure can be understood in detail, a more particular description of the invention may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatuses, methods, techniques, and/or instruction sequences that embody techniques of the present subject matter. However, it is understood that the described embodiments may be practiced without these specific details.

The present disclosure relates to a downhole drilling tool including a bottomhole assembly (BHA) with a drill bit at an end thereof. The BHA also includes a vibration assembly including an axial assembly and/or a radial assembly to selectively move the drilling tool during drilling. The axial assembly may include various arrangements of drilling components, such as a pulser (or agitator), a shock tool, and a hole enlarger (e.g., reamer, under reamer, hole enlarger, and/or non-expanding hole enlarger), for providing axial movement of the drilling tool. The radial assembly may include expanders extendable from various portions of the drilling tool, such as the hole enlarger and/or the drill bit, to vibrationally engage a wall of the wellbore.

Forces on the drilling tool may cause excessive friction and torque which may negatively impact drilling, for example, by increasing drilling tool temperature and accelerating wear or other damage. The axial and/or radial assemblies may be configured alone or in combination to provide movement, such as vibration, pulsing, and/or hammering of the drilling tool, to offset or disturb damaging drilling effects, such as lateral vibration, bit whirl, resonant vibration, and stick slip. The axial and/or vibrational assemblies may also be used to centralize the drilling tool, to resist premature damage to the drilling tool, to increase rate of penetration (ROP), to offset the forces that may negatively impact drilling, to permit the drilling tool to cool down, and/or to facilitate drilling.

Figure 1:
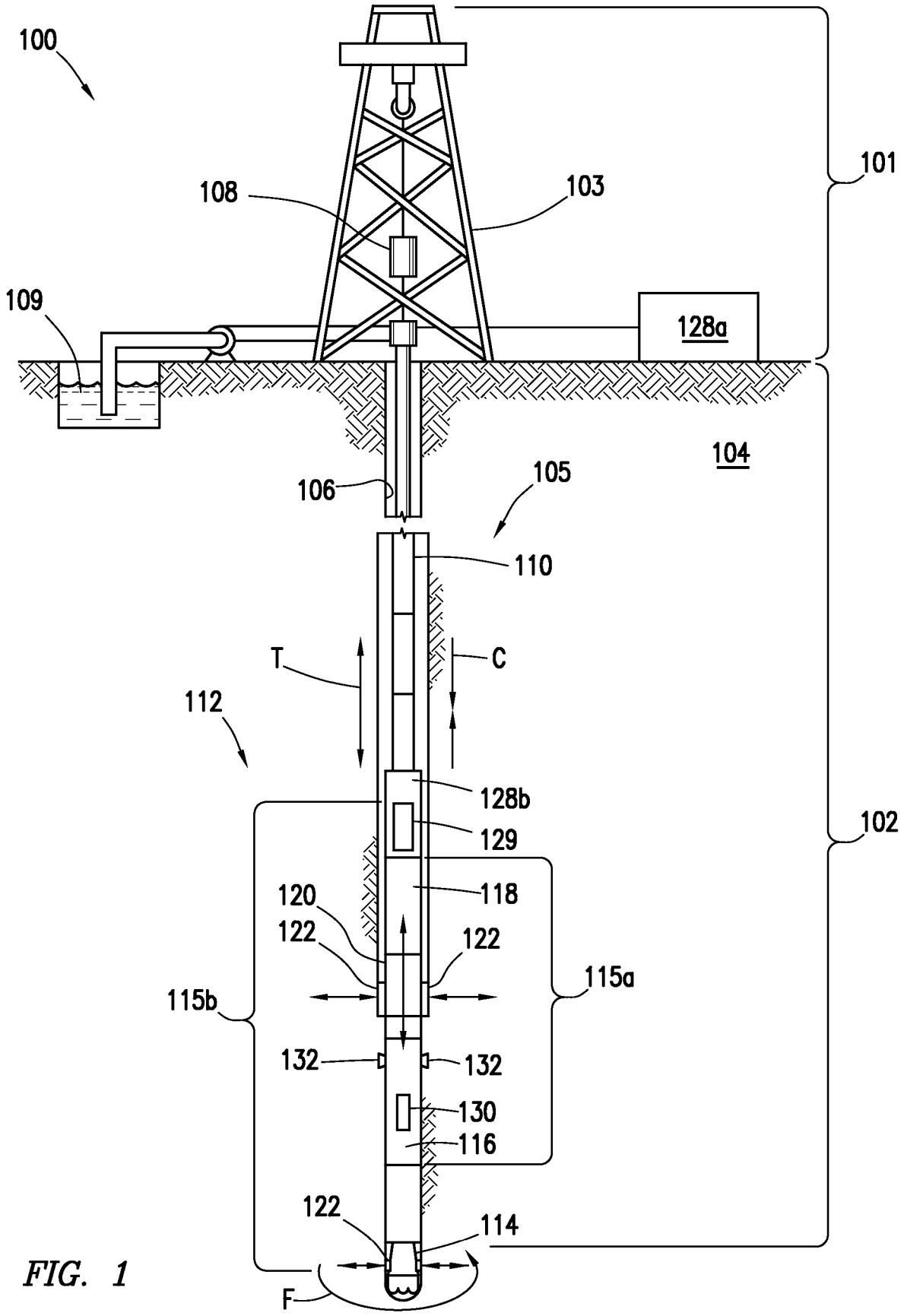
FIG. 1 depicts a schematic view, partially in cross-section, of a wellsite having a surface system and a downhole system for drilling a wellbore, the downhole system having a drilling tool with a vibration assembly including an axial assembly and a radial assembly.

FIG. 1 depicts a schematic view, partially in cross-section, of a wellsite 100. While a land-based drilling rig with a specific configuration is depicted, the present disclosure may involve a variety of land based or offshore applications. The wellsite 100 includes surface equipment 101 and downhole equipment 102. The surface equipment 101 includes a rig 103 positionable about subterranean formation 104 for performing various wellbore operations, such as drilling a wellbore 106.

The surface equipment 101 may include various rig equipment 108, such as a Kelly, rotary table, top drive, elevator, etc., provided at the rig 103 to operate the downhole equipment 102. A mud pit 109 may be provided as part of the surface equipment 101 for passing mud from the surface equipment 101 and through the downhole equipment 102. Various flow devices, such as a pump may be used to manipulate the flow of mud about the wellsite 100.

The flow of mud may be used to activate various portions of the downhole equipment 102. The downhole equipment 102 may include a downhole drilling tool 105 including a drill string 110 with a bottomhole assembly (BHA) 112 and a drill bit 114 at an end thereof. Fluid from the mud pit 109 may be passed through the drill string 110, BHA 112, and out drill bit 114 as the drill bit 114 is advanced into the formation 104 to form the wellbore 106.

The drill string 110 may include drill pipe, drill collars, coiled tubing or other tubulars used in drilling operations. The BHA 112 is at a lower end of the drill string 110 and contains various downhole components for performing downhole operations. As shown, the BHA 112 includes an axial assembly 115*a* and a radial assembly 115*b* that may be used to generate movement. The axial and/or radial assemblies 115*a,b* may act as a vibration assembly to vibrate against a wall of the wellbore 106 to offset the damaging drilling effects of the drilling tool 105. The BHA 112 may also include various other downhole components, such as stabilizers, a measurement while drilling tool, a logging while drilling tool, a telemetry unit, rotary steerables, and/or other downhole components.

The axial assembly 115*a* includes a pulser 116, a shock tool 118, and a hole enlarger (or opener) 120. The axial assembly 115*a* may be used to provide axial movement of the downhole tool 105 as indicated by the double arrow. The pulser 116, shock tool 118, and hole enlarger 120 may interact to generate desired axial and/or radial movement. The pulser 116 may include a valve system 130 with nozzles 132 for applying fluid to the wall of the wellbore 106. This pressure may be used to cause the formation 104 to be locally over pressured for engagement by the hole enlarger 120, or in other words, to condition the formation 104.

The pulser 116 may generate pulses by selectively closing the valve system 130 to interrupt mud flow therethrough. The pressure pulses generated by the pulser 116 may be symmetrical or non-symmetrical. Non-symmetrical pulses may be used to prevent the damaging drilling effects from developing at the hole enlarger 120. These pressure pulses at the nozzles 132 may be used to pressurize and jet fluid at the wall of the wellbore 106 to be engaged by expanders 122 of the hole enlarger 120. Applying pressure to the wall of the wellbore 106 to be cut by the expanders 122 may be used to increase formation pressure below the expanders 122, for example, to eliminate hydraulic chip hold down and increase ROP.

The valve system 130 may include, for example, a rotary valve driven by a positive displacement motor capable of creating cyclical pressure pulses at a frequency (e.g., from about 15 to about 30 Hz). The valve may selectively close to block flow of the mud therethrough to create positive pressure pulses that are applied to the hole enlarger 120. Pulsing the flow of mud through the nozzles 132 may be used to produce increased pressure peaks in the pulser 116. This pulsing provides a 'water hammer' effect and varies forces on the BHA 112. Examples of pulsers are provided in U.S. Pat. No. 6,279,670 and application Ser. No. 13/954,793, previously incorporated by reference herein. An example pulser that may be used is the AGITATOR™ commercially available at www.nov.com.

The shock tool 118 may be, for example, a dampening tool that, when used with the pulser 116, is capable of converting pressure pulses into mechanical vibration in the BHA 112. Examples of shock tools that may be used include the BLACK MAX MECHANICAL SHOCK TOOL™ or a GRIFFITH™ shock tool (e.g., 6¾" (17.14 cm) with a pump open area of 17.7 $in^2$ (114.19 $cm^2$)) commercially available at www.nov.com.

The hole enlarger 120 may be, for example, a reamer, under reamer, hole enlarger, non-expanding hole enlarger, and/or other device capable of enlarging the wellbore 106. Examples of hole enlargers are provided in U.S. Pat./Application Nos. 2010/0181115, 2012/0055714, U.S. Pat. Nos. 8,307,921, 7,823,663, 7,703,553, 7,958,953, and 6,615,933, previously incorporated herein. The hole enlarger 120 may include expanders 122, such as cutting blocks, extendable therefrom to enlarge the wellbore wall. The hole enlarger 120 may be activatable, for example, by dropping a ball therethrough.

The radial assembly 115*b* may include the expanders 122 to radially expand and engage a wall of the wellbore 106 during drilling. The expanders 122 may be positioned about the BHA 112 and/or drill bit 114 as shown. The expanders 122 may be, for example, the cutting blocks or pads repeatedly and radially vibrationally movable about the hole enlarger 120 to vibrationally engage the wall of the wellbore 106 as indicated by the radial arrows. The expanders 122 of the hole enlarger 120 may be extended during rotation of the drill string 110 to enlarge a pilot hole formed by the bit 114 and/or vibrated to repeatedly engage the wall of the wellbore 106 to offset forces of the drilling tool 105.

The drilling tool 105 may be rotated and advanced during drilling. As the drilling tool 105 is advanced, forces, such as torque F, tension T, and compression C as shown, may be applied to the drilling tool 105 which may cause the drilling tool 105 to experience lateral vibration, bit whirl, resonant vibration, stick slip, and/or other damaging drilling effects during drilling.

The axial assembly 115*a* and/or the radial assembly 115*b* may be used separately or in combination to provide movement, such as vibration, of the downhole tool. In this manner, the axial and/or radial assemblies 115*a,b* may form a vibration assembly for vibrating the downhole tool. The axial movement of the axial assembly 115*a* and/or the radial movement of the radial assembly 115*b* may be used to affect movement of the drill bit 114 to offset the damaging drilling effects. Axial movement of the axial assembly 115*a* may also be used to activate the expanders 122 thereby generating radial vibration from the axial movement. The movement of the downhole tool 105 may thereby be manipulated using various movement of the axial assembly 115*a* and/or the radial assembly 115*b* to achieve desired drilling.

One or more controllers 128*a,b* may be provided to operate the wellsite 100. For example, a surface controller 128*a* may be provided at the surface and a downhole controller 128*b* may be provided in the drilling tool 105. The controller(s) 128*a,b* may be provided with measurement and/or data control devices (e.g., processors, central processing units, etc.) to collect and/or analyze drilling data. The controller(s) 128*a,b* may operate the surface and/or downhole equipment 101, 102 based on the drilling data.

The downhole controller 128*b* may be provided with a downhole actuator 129 to activate the axial assembly 115*a* and/or the radial assembly 115*b*. For example, the downhole actuator 129 may be a hydraulic, electronic, and/or mechanical actuator (e.g., indexer, motor, piston/cylinder, etc.) capable of selectively activating the expanders 122 for vibrational engagement with the wall of the wellbore 106. In some cases, the axial assembly 115*a* may interact with and act as the actuator for the radial assembly 115*b*.

FIGS. 2A-2E show various configurations of an axial assembly 215*a-e* usable as the downhole components of the BHA 112. As schematically shown by these figures, the axial assembly 215*a-e* may include various arrangements of one or more of the pulsers 116, the shock tools 118, hole enlargers 120, and/or other components positioned in various configurations and at various locations about the BHA 112 to affect forces acting on the drilling tool 105. These configurations demonstrate examples of axial assemblies 215*a-e* that may be used to generate axial movement.

The configurations of the axial assembly 215*a-e* may be selected to achieve desired drilling performance. In each configuration depicted, the pulser 116 is positioned downhole from the hole enlarger 120. The pulser 116 may be positioned below the hole enlarger 120, for example, to condition the formation 104 for engagement by the hole enlarger 120 and/or to produce positive pulses that generate the water hammer effect. Pressure pulses of the pulser 116 may act on the shock tool 118 to produce axial forces.

The shock tool 118 may be in various positions about the pulser 116 and/or the hole enlarger 120. The shock tool 118 may be used to apply expansion or contraction to the axial assembly 215*a-e* as indicated by the arrows. The water hammer effect created by the pulser 116 may be larger than a rebound force exerted by the shock tool 118. Each time pressure changes during a cycle, the shock tool 118 may be used to convert this pressure change and/or pulses into an axial movement.

The shock tool 118 may also be used in conjunction with the pulser 116 to produce pulses of tension and/or compression forces. For example, the shock tool 118 and pulser 116 may be combined such that the pulser 116 may produce about 600 psi (42.19 $Kg/cm^2$) pressure pulses and the magnitude of the cyclical axial forces produced by the shock tool 118 may be about 17.7 $in^2 \times 600$ psi=10,670 lbs (4839.8 Kg). Interaction of the pulser 116 and shock tool 118 may cyclically vary weight on bit (WOB) and the proportion of the WOB split between the bit 114 and the hole enlarger 120.

The shock tool 118 may be positioned relative to the hole enlarger 120 and the pulser 116 to achieve the desired effect. The force generated along the BHA 112 when the pulser 116 interrupts the mud flow may be either compressive (the shock tool 118 extends) or tensile (the shock tool 118 retracts) depending on where the shock tool 118 is positioned in the BHA 112 relative to the pulser 116. If the shock tool 118 is placed upstream from the pulser 116 as in FIGS. 2A-2B and 2D, then each time the pulser 116 closes, it may produce a temporary pressure increase at the shock tool 118. This may cause the shock tool 118 to increase in length as compressive forces in the BHA 112 are generated above and below the shock tool 118. When the pulser 116 opens again, the shock tool 118 may retract, and the shock tool 118 reduces in length. When the shock tool 118 is downstream from the pulser 116 as in FIGS. 2C and 2D, each time the pulser 116 closes, the shock tool 118 experiences a negative pressure pulse that causes the shock tool 118 to retract.

Figure 2C:
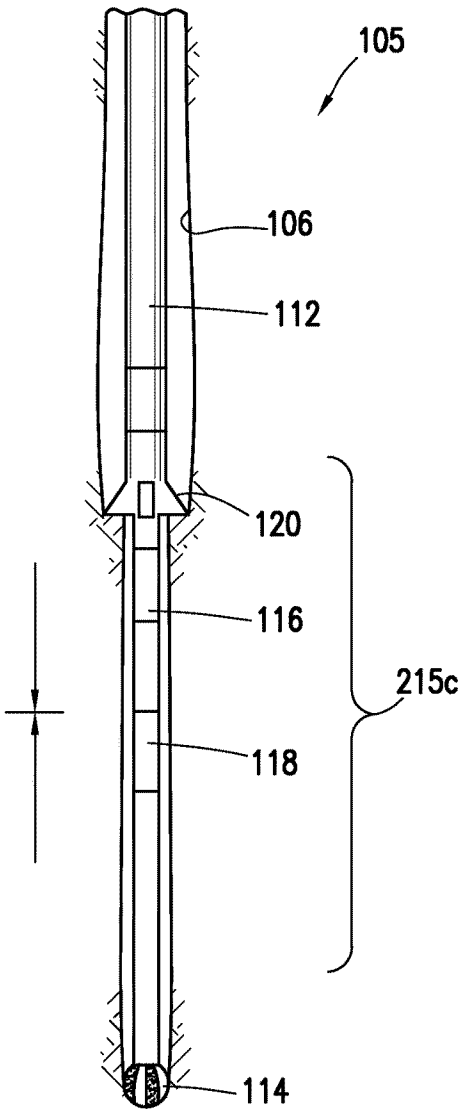
FIGS. 2A-2E depict schematic views of the axial assembly including a hole enlarger, a pulser, and a shock tool in various configurations.
Figure 2B:
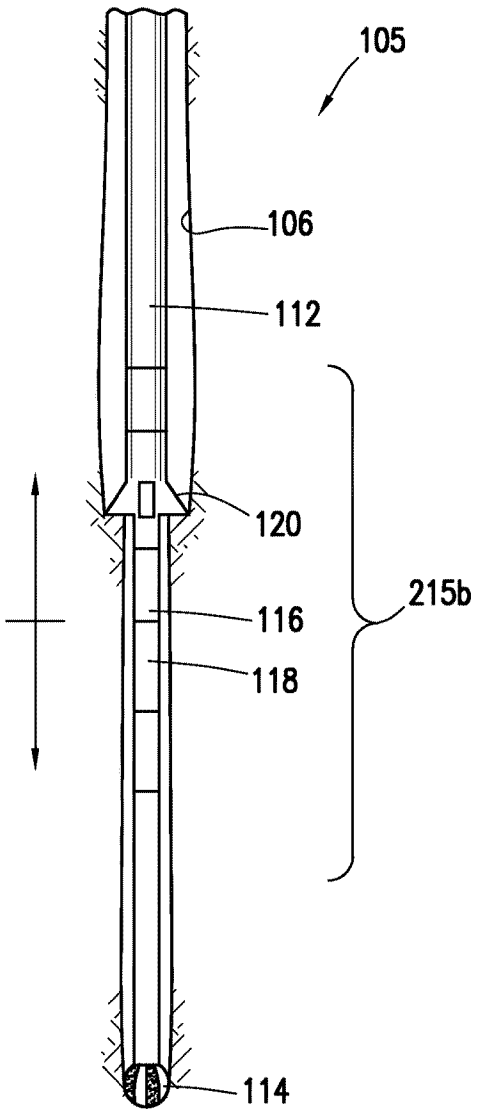
Figure 2A:
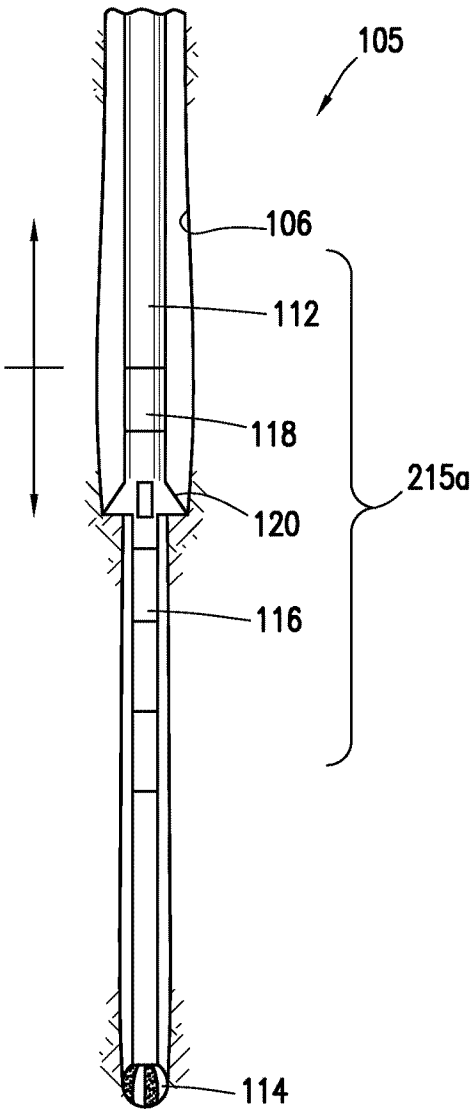

For example, in FIG. 2A, the shock tool 118 is uphole from hole enlarger 120. In this configuration, weight on both the hole enlarger 120 and the drill bit 114 may be increased simultaneously. With the shock tool 118 upstream from the pulser 116, when the valve in the pulser 116 closes, there will be a pressure increase at the shock tool 118. This causes the shock tool 118 to extend and push upwards on or compress the BHA 112 above the shock tool 118 and push downwards on or compress the BHA 112 below. This will temporarily increase the weight on both the bit 114 and the hole enlarger 120. When the pulser 116 opens again, the pressure at the shock tool 118 reduces and the shock tool 118 retracts, thus reducing the weight on the hole enlarger 120 and the drill bit 114.

In the example of FIG. 2B, the shock tool 118 is between the hole enlarger 120 and the drill bit 114. In this configuration, weight on the drill bit 114 is increased and weight on the hole enlarger 120 decreased as the shock tool 118 expands below the hole enlarger 120. The shock tool 118, positioned upstream of the pulser 116, expands when the pulser valve closes, and the shock tool 118 pushes upwards on the hole enlarger 120 and downwards on to the bit 114. This will increase the weight on the bit 114 and reduce the weight on the hole enlarger 120.

In the example of FIG. 2C, the shock tool 118 is downhole from the hole enlarger 120. In this configuration, weight on the drill bit 114 is decreased slightly and weight on the hole enlarger 120 is increased as the shock tool 118 contracts below the hole enlarger. The shock tool 118 is positioned downstream from the pulser 116 so the shock tool 118 retracts when the pulser valve closes. Conversely, when the pulser valve opens again, this decreases the weight on the hole enlarger 120 and increases the weight on the bit 114.

Figure 2E:
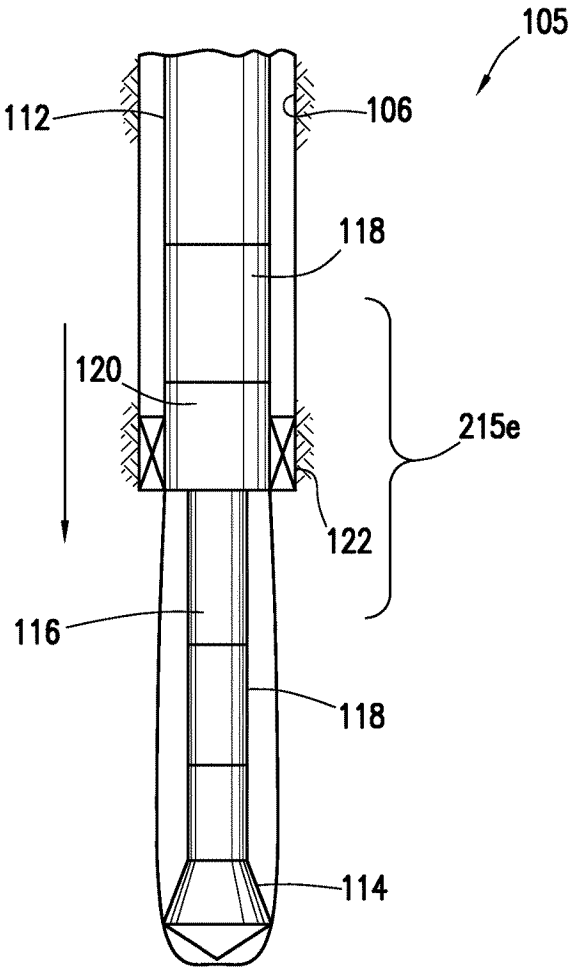
Figure 2D:
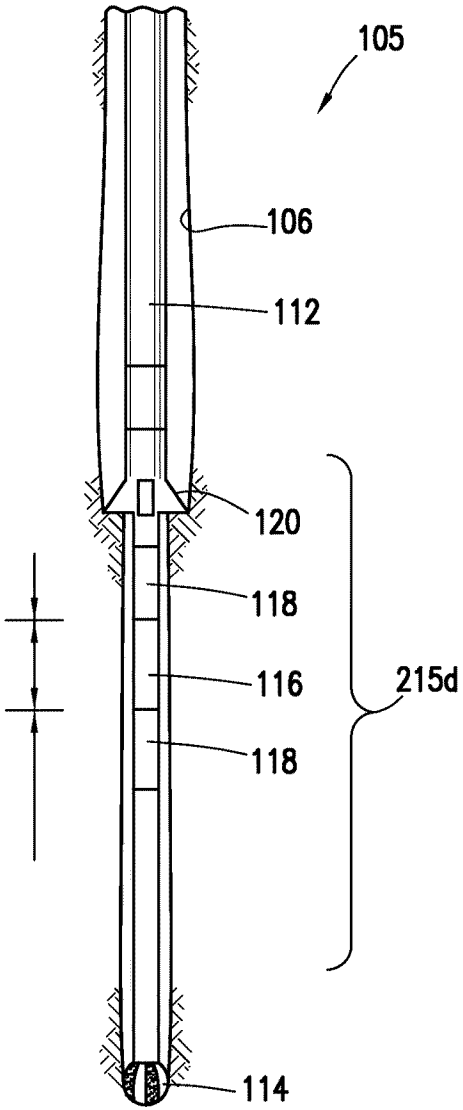

In the example of FIG. 2D, two shock tools 118 are positioned in the BHA 112 with a shock tool 118 upstream from the pulser 116 and another shock tool 118 downstream from the pulser 116. In this configuration, a portion of the BHA 112 between the shock tools 118 oscillates independently. This oscillation provides an oscillating mechanical force to the BHA 112. This movement places the portion of the BHA 112 above the pulser 116 in compression and the portion of the BHA 112 below the pulser 116 in tension, and vice versa.

In this option, shock tools 118 are positioned both upstream and downstream of the pulser 116. When the pulser valve closes, the upstream shock tool 118 extends and the lower shock tool 118 retracts, and the pulser 116 (along with any other BHA components between the shock tools 118) moves down. The pulser 116 oscillates as the pulser 116 cycles. The momentum of this oscillating mass produces cyclical variations in weight on both the hole enlarger 120 and the bit 114. The positioning of the bottom shock tool 118 may negate the extension/retraction forces that the top shock tool 118 may otherwise cause when the top shock tool 118 gets longer/shorter. One of the shock tools 118 may expand as the other shock tool 118 retracts, thus preventing any overall extension of the BHA 112.

In the example of FIG. 2E, the pulser 116 is positioned upstream and downstream from shock tools 118. In this case, when the valve of the pulser 116 closes, the pulser 116 produces positive pressure pulses upstream and negative pulses downstream, and the shock tools 118 receive opposite pressure pulses therefrom. Shock tools 118 are also placed in the BHA 112 with one above and one below the hole enlarger 120. This may be used to cause the portion of the BHA 112 including the hole enlarger 120 to move down and the expanders 122 to extend towards the wall of the wellbore 106. When the pulser valve opens again the process reverses and the cycle is then repeated at the frequency of the pulser 116.

Figure 3A:
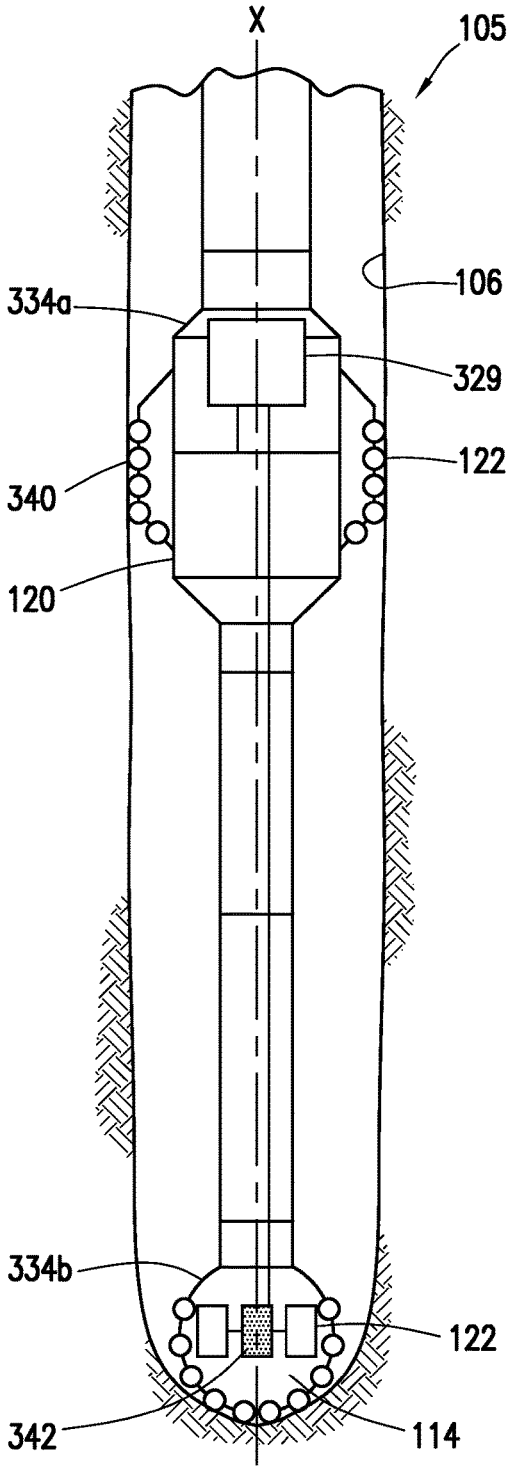
FIGS. 3A-3B are schematic views of a portion of the drilling tool and the drill bit, respectively, depicting the radial assembly therein.
Figure 3B:
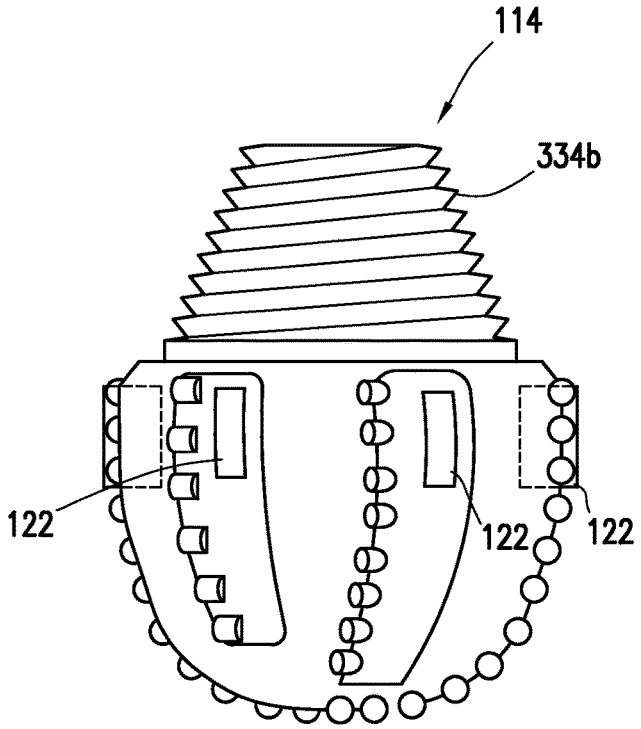

FIGS. 3A and 3B show example configurations of expanders 122 positioned in a portion of the drilling tool 105 and the drill bit 114, respectively. As shown in FIG. 3A, the expanders 122 are cutting blocks positioned in the hole enlarger 120 in BHA 112. As shown in FIG. 3B, the expanders 122 are pads positioned in the drill bit 114.

The expanders 122 of FIG. 3A may be positioned in an enlarger housing 334*a*, such as a drill collar of the hole enlarger 120. The hole enlarger 120 may have an activator 329 for selectively extending and/or retracting the expanders 122. The activator 329 may be, for example, a radial vibrator capable of repeatedly extending and retracting the expanders 122 such that they repeatedly engage the wall of the wellbore 106. The expanders 122 may be activated individually, selectively, and/or in unison. The expanders 122 may be extended at any angle offset from an axis X of the downhole tool 105.

The activator 329 may be a hydraulic, electronic, or mechanical activator, driven by, for example, hydraulic drilling fluid pressure, closed circuit hydraulic system, electromechanical devices etc. The activator 329 may vibrate the expanders 122 radially to generate a vibrational movement. The vibrational movement may be, for example, a relatively small radial movement in comparison to a total expansion ratio of the hole enlarger 120. For example, the vibrational movement may be about 1/16 inches (0.32 cm) and the hole enlarger movement about 2 inches (5.08 cm). The activator 329 may also extend and retract the expanders 122 at a frequency greater than the rotational speed of the drilling tool, such as about 20 Hz.

As shown in FIG. 3B, the expanders 122 may be positioned in a bit housing 334*b* of the drill bit 114 and extended therefrom. The bit housing 334*b* may be, for example, a conventional drill bit (e.g., a polycrystalline diamond drill bit or matrix drill bit) provided with holes for movably receiving the expanders 122 therein. Examples of drill bits with cutting devices are provided in U.S. Pat. No. 4,690,229, the entire contents of which are hereby incorporated by reference herein.

The expanders 122 of the drill bit 114 may be the same as the expanders of the hole enlarger 120 and be extended and retracted in the same manner. The expanders 122 may be any type of expansion devices, such as pads (e.g., expanding gauge pads, expander pads and/or expansion devices) and/or cutter blocks (spring or hydraulically activated), movable to provide vibrational contact with the wall of the wellbore 106. The expanders 122 may incorporate, for example, cutters 340 and/or a wear resistant coating 342. The expanders 122 of the drill bit 114 may use the same or a different activator 329. The activator(s) 329 may be part of or operated by the controllers 128*a,b* (FIG. 1).

In order to address the damaging drilling effects, force may be applied by the expanders 122 to vibrationally engage the wall of the wellbore 106 to reduce damaging movement of the drilling tool 105, such as bit whirl. The expanders 122 may also be extended to centralize the drilling tool 105 and/or to improve stability. Any number of expanders 122 may be vibrated against the wall of the wellbore 106 during drilling. Such vibration may simultaneously or separately expand and retract the expanders 122 at a given frequency. This vibration may be used to provide an intermittent centralizing or offset force within the wellbore 106 and at a frequency selected to prevent damaging resonant vibration from becoming established.

One or more of the expanders 122 may be selectively extended to steer advancement of the drilling tool 105. The expanders 122 may be vibrated to advance the wellbore 106 in a desired direction, and the expanders 122 may be individually vibrated at a frequency synchronized to the rotational speed of the drilling tool 105.

Multiple expanders 122 at one or more locations (e.g., axial and/or radial positions) may be vibrated in unison at relatively high frequency (a number of times per revolution of the drill string 110) to centralize the drilling tool 105 a number of times per revolution while avoiding continuous rubbing contact with the wellbore 106. In another example, the pulsing frequency of the expanders 122 may be selected away from any lateral or torsional natural vibration frequencies generated by the bit 114 to resist damaging resonant vibration from becoming established.

FIGS. 4A-7B provide an example configuration of a hole enlarger 120 positioned along the BHA 112. These figures depict features of the hole enlarger 120 extendable from the BHA 112 for engagement with the wall of the wellbore 106. In these figures, the hole enlarger 120 may be, for example, an under reamer with expanders (e.g., cutter blocks) 122 used to enlarge the wellbore 106. The hole enlarger 120 may be used as an activator 429 to selectively extend the expanders 122.

Figure 4A:
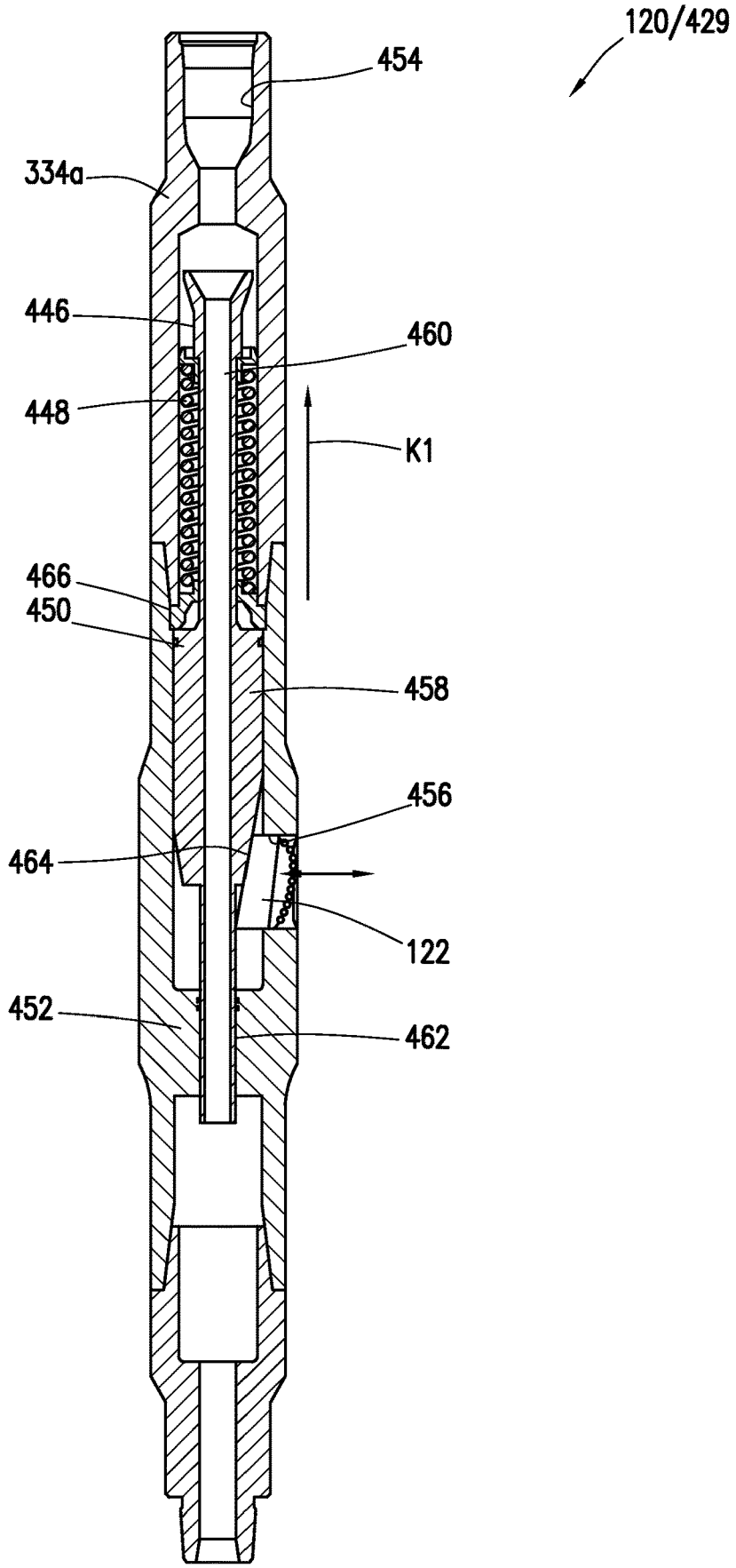
FIGS. 4A 4B are longitudinal cross-sectional views of the drilling tool depicting the axial assembly in a retracted position and an extended position, respectively.
Figure 4B:
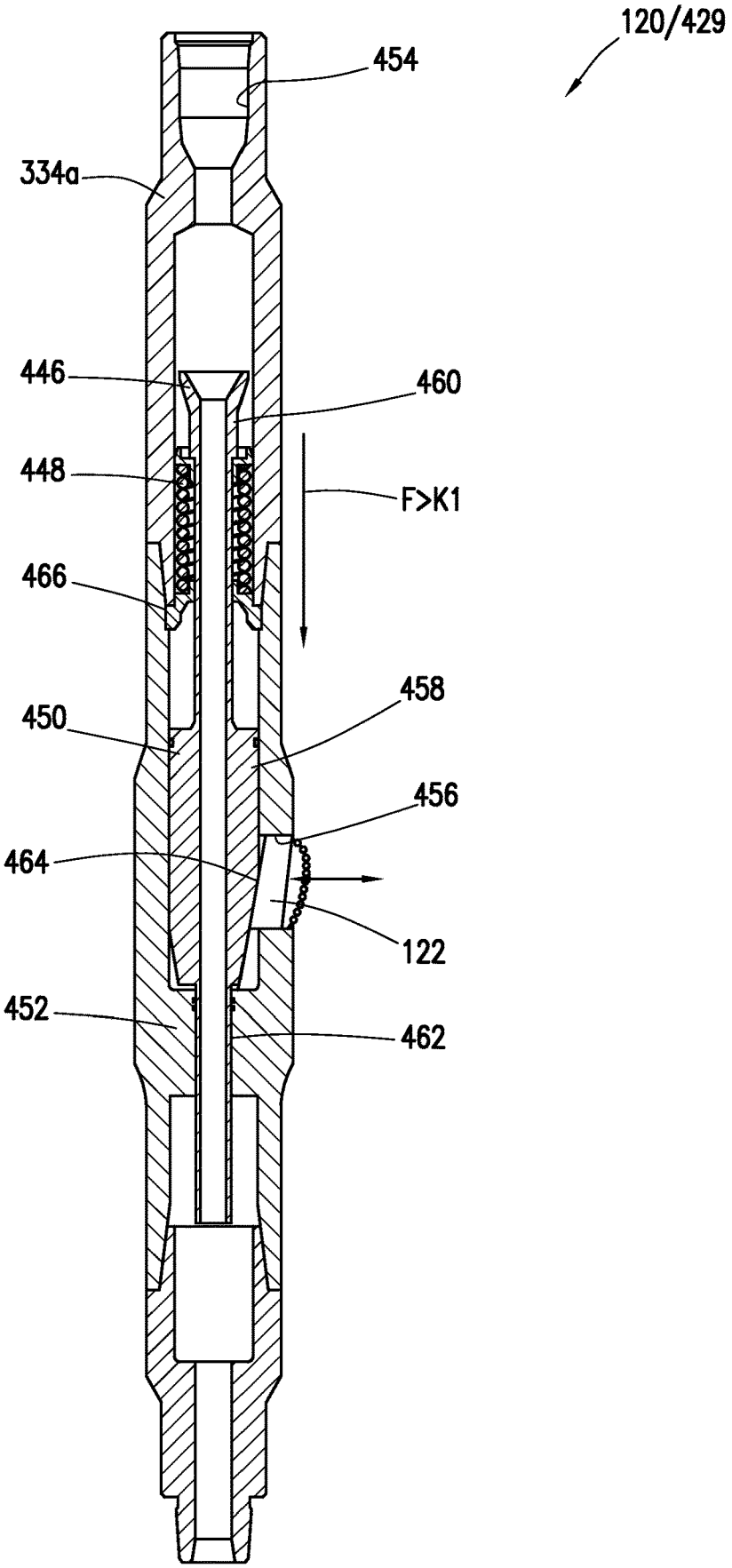
Figure 5A:
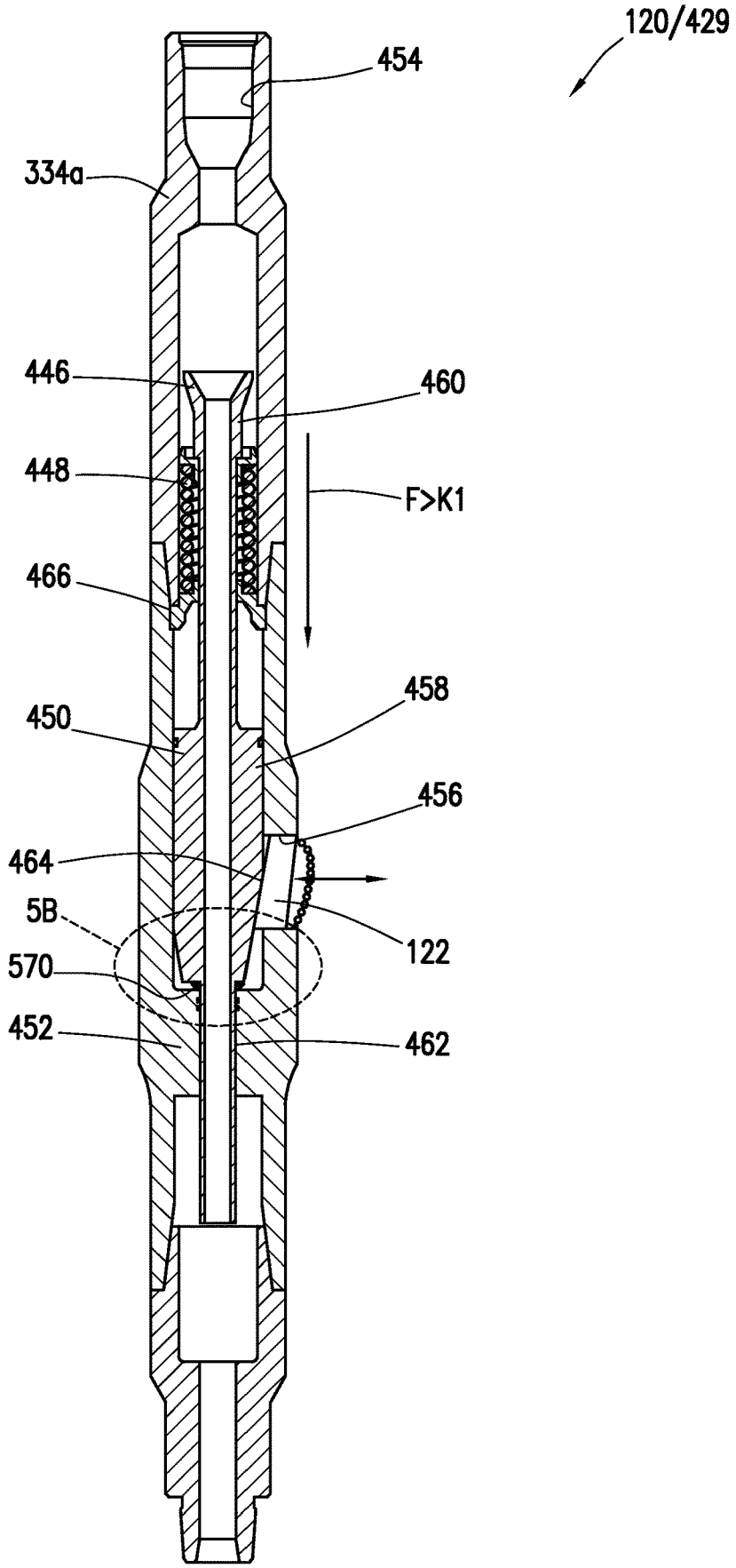
FIG. 5A is a longitudinal cross-sectional view of the drilling tool depicting the axial/vibration assembly with a vibration spring.
Figure 5B:
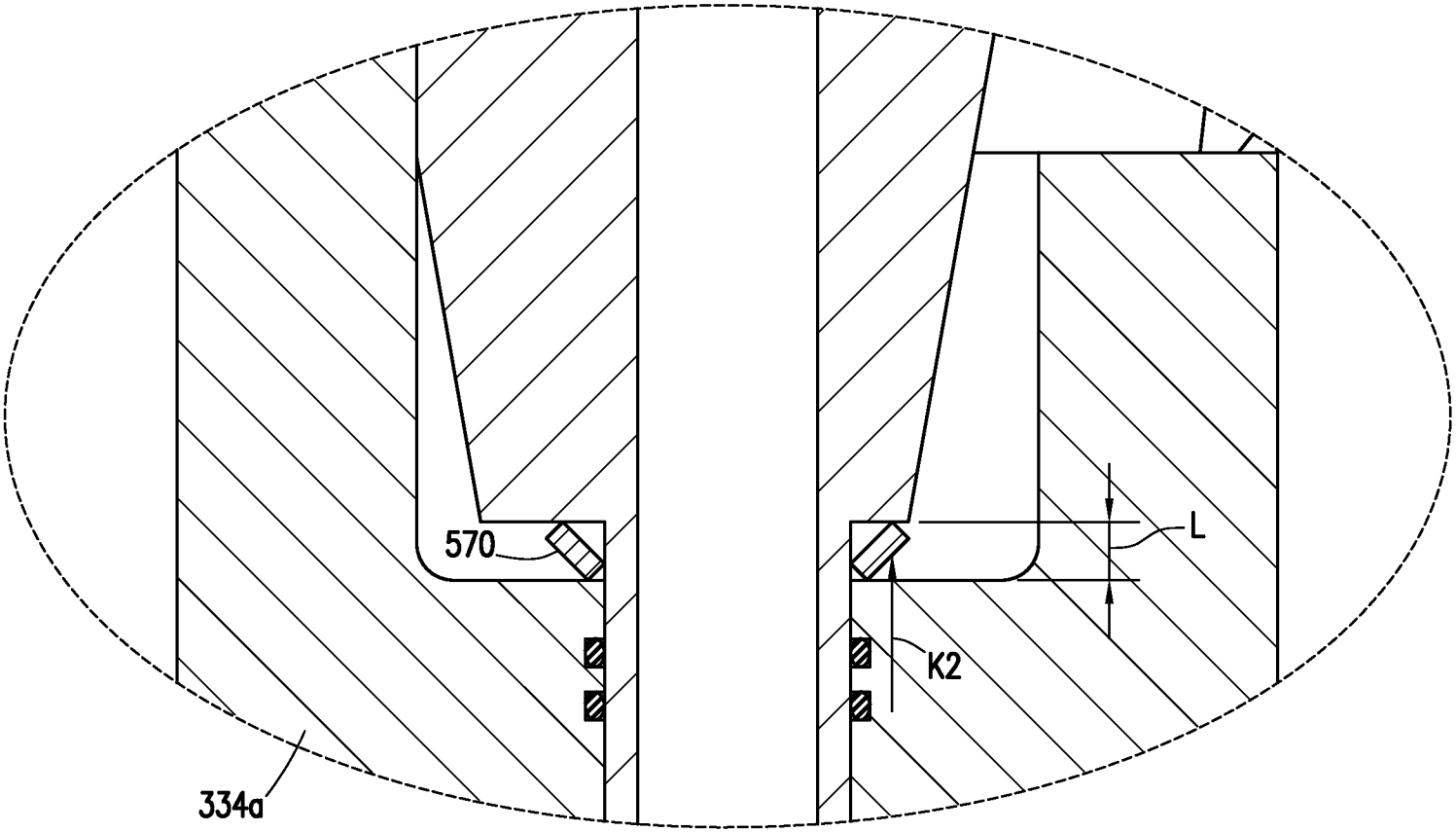
FIG. 5B is a detailed view of a portion 5B of the axial assembly of FIG. 5A depicting the vibration spring.

FIGS. 4A and 4B show an example configuration of the hole enlarger 120 positioned about the BHA 112 to enlarge the wellbore 106 (FIG. 1). FIG. 4A shows the hole enlarger 120 with the expander 122 in a retracted position. FIG. 4B shows the hole enlarger 120 with the expander 122 in an extended position. FIG. 5A shows the hole enlarger 120 provided with a vibration spring 570. FIG. 5B shows a portion 5B of the hole enlarger 120 showing the vibration spring 570 in greater detail. The hole enlarger 120 may be activated by pressure pulses received from the pulser 116 and/or may be used in conjunction with the shock tool 118.

Various configurations of the hole enlarger 120 may be provided. As shown in these figures, the hole enlarger 120 includes the enlarger housing 334*a*, the expander 122, a mandrel 446, and a enlarger spring 448. The hole enlarger 120 may be provided with seals 450 thereabout to restrict fluid flow therethrough.

The enlarger housing 334*a* may include one or more sections threadedly connected to form a tubular member for receiving the mandrel 446 therein and to pass mud therethrough. The enlarger housing 334*a* may have an inner surface configured to slidingly receive the mandrel 446. The mandrel 446 acts as a piston movable within the enlarger housing 334*a* which acts as a cylinder. The mandrel 446 may travel axially through the enlarger housing 334*a* a distance of, for example, about 8 inches (20.32 cm).

The enlarger housing 334*a* may also have supports (e.g., a centralizer) 452 to support the mandrel 446 therein. An enlarger passage 454 may extend through the enlarger housing 334*a* for the passage of mud therethrough. Expander receptacles 456 are also provided in the enlarger housing 334*a* to receive the expanders 122.

The mandrel 446 includes a cam or ramp portion 458, a spring portion 460, and a support portion 462. The cam portion 458 is between the spring portion 460 and the support portion 462. The support portion 462 is slidably receivable in the support 452 of the enlarger housing 334*a*. The cam portion 458 is slidably receivable along an inner surface of the enlarger housing 334*a*. The cam portion 458 has a cam or ramp surface 464 engageable with an outer surface of the expander 122. The cam surface 464 may be at an angle to engage the expanders 122 and drive the expanders 122 outward as the mandrel 446 is advanced downhole. The expander 122 is selectively extendable and retractable from the enlarger housing 334*a* by axial movement of the mandrel 446.

The spring portion 460 has a spring support 466 and the enlarger spring 448 thereabout. The spring support 466 is fixedly positioned in the enlarger housing 334*a*. The enlarger spring 448 is compressible against the support 452 as the mandrel 446 moves toward the expanders 122. The enlarger spring 448 has a spring force K1 that urges the mandrel 446 to the retracted position of FIG. 4A.

The enlarger spring 448 is urged to a compressed position by force on the mandrel 446 generated by flow of drilling fluid through the enlarger housing 334*a* as indicated by the arrow K1 of FIG. 4B. The enlarger spring 448 retracts when a force driving the mandrel 446 is less than K1, for example upon termination of flow through the downhole tool 105.

As shown in FIG. 4B, the mandrel 446 may be advanced by applying a force F sufficient to overcome the spring force K1 of the enlarger spring 448. This may be done, for example by applying flow of mud through the passage 454. The movement of the mandrel 446 and engagement by the cam surface 464 may be used to selectively extend and retract the expanders 122. As the mandrel 446 is advanced to a downhole position, cam surface 464 engages the expander 122 and advances the expander 122 radially outward to engage the wall of the wellbore 106. The hole enlarger 120 translates axial movement of the mandrel 446 into radial movement of the expander 122.

FIGS. 5A and 5B show a vibrational version of the hole enlarger 120. FIG. 5A shows a cross-sectional view of the hole enlarger 120. FIG. 5B shows a detailed view of a portion 5B of the hole enlarger 120 of FIG. 5A. The hole enlarger 120 is provided with vibration spring 570, such as a Bellville spring, to provide additional movement, such as vibration of the expanders 122.

The vibration spring 570 is provided between a downhole end of the cam portion 458 of the mandrel 446 and the support 452 of the enlarger housing 334*a*. The vibration spring 570 is compressible between the cam portion 458 and the support 452 to provide a spring force K2 therebetween. The movement of the mandrel 446 may be used to overcome the force of the vibration spring 570 in the same manner as the enlarger spring 448.

The vibration spring 570 may be positioned between an end of the cam portion 458 of the mandrel 446 and the support 452 to provide axial resistance therebetween. The resistance of the vibration spring 570 may interact with the various forces, such as pressure pulses generated by the pulser 116, pressure drop generated by flow of mud through the passage 454, to provide additional vibration and/or movement about the hole enlarger 120.

The mandrel 446 may be vibrationally moved by engagement with the vibrational spring 570. The vibration spring 570 may also be used to allow a small amount of movement of the mandrel 446. This movement may provide very small expansion and contraction of the expanders 122 at a frequency of, for example, the pressure pulses applied to the mandrel 446. The amplitude of this movement may be limited to ensure that an overall gauge diameter of the hole enlarger 120 is maintained within a desired range.

The hole enlarger 120 may be configured to react to pressure pulses from the pulser 116. The mandrel 446 is spring loaded by enlarger spring 448 and/or vibration spring 570 to allow slight movement as pressure pulses from the pulser 116 are applied thereto. The expanders 122 may extend and retract radially in response to pressure pulses applied to the hole enlarger 120. The enlarger spring 448 and/or vibration spring 570 mounted on the mandrel 446 may also be responsive to pressure pulses.

The amount of vibrational movement of the expanders 122 by the mandrel 446 may be limited by a stroke length L of the vibration spring 570. The vibration spring 570 may provide a small movement with select accuracy to provide, for example, limited movement when pulses are applied by the pulser 116 to the hole enlarger 120. The vibration spring 570 may be used to vary the actuated diameter of the hole enlarger 120 within specified limits, to provide a relatively solid stop to ensure a diameter range of the hole enlarger 120, and to apply a return force against pressure applied to mandrel 446 as the mandrel 446 is located near the end of its down-stroke and the pressure fluctuates depending on a number of variable factors (e.g., flow rate, mud weight, bit pressure drop, pulsing etc.) Factors may vary from well to well, so that the spring stiffness of vibration spring 570 may be soft enough to ensure that the mandrel 446 contacts the support 452 even at lower values of flow rate, mud rate etc.

During operation, the hole enlarger 120 is activated so that the mandrel 446 is advanced toward a downhole end to compress the enlarger spring 448. When the mandrel 446 reaches a downhole end of its stroke, the cam portion 458 applies force to extend the expanders 122. The vibration spring 570 may prevent further downward movement of the mandrel 446 until the force K2 is overcome. Any subsequent increase in pressure may have no effect once the vibration spring 570 is compressed.

The vibration spring 570 may have a higher spring stiffness than the enlarger spring 448 (K2>K1) to provide vibrational movement of the expanders 122. When pressure pulses from the pulser 116 are applied to the hole enlarger 120, pressure peaks compress the vibration spring 570 slightly (e.g., about 0.25" (0.63 cm)) thereby generating a small high frequency of vibration of the expanders 122.

Figure 6A:
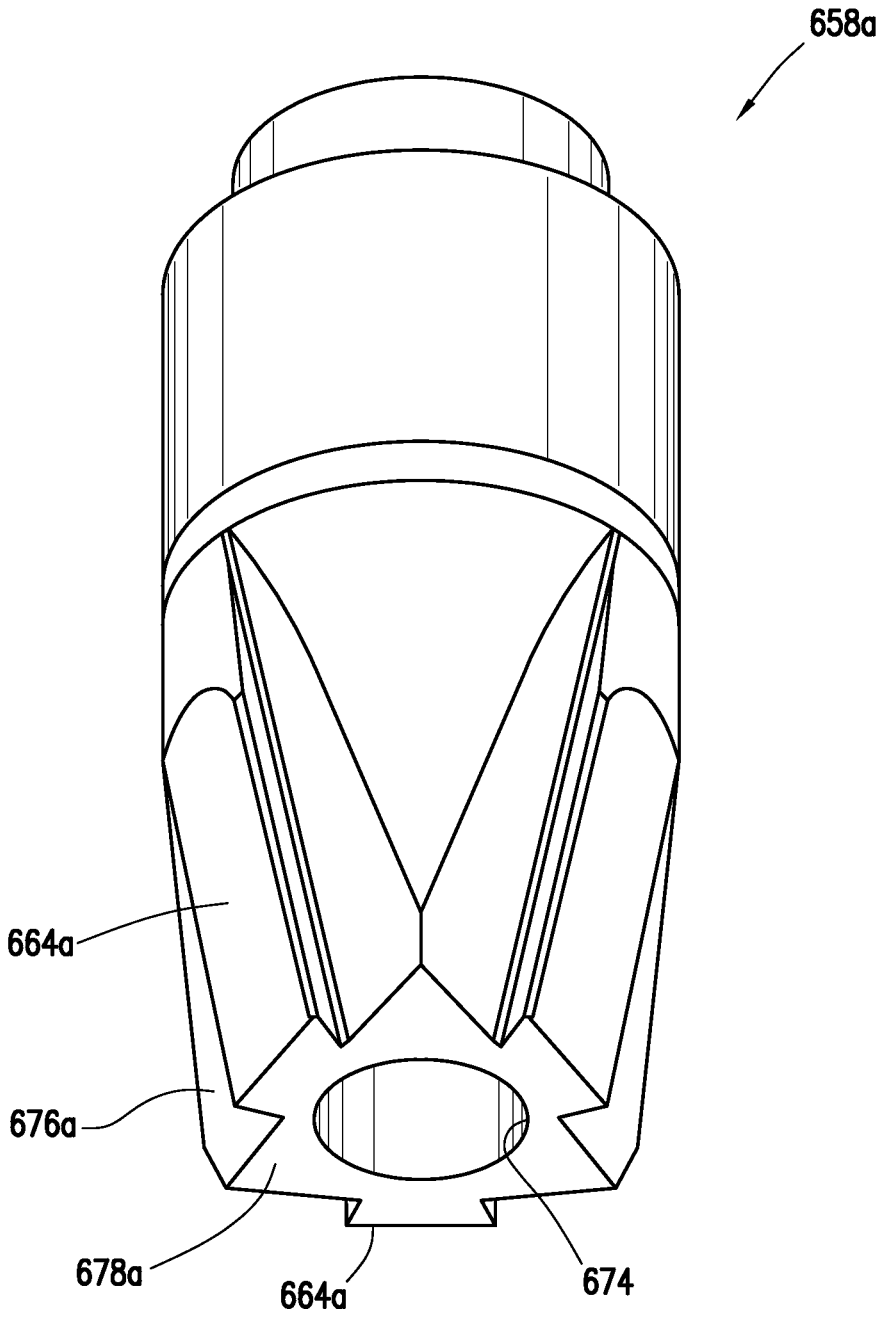
FIGS. 6A and 6B are perspective views of a cam portion of the axial assembly.
Figure 6B:
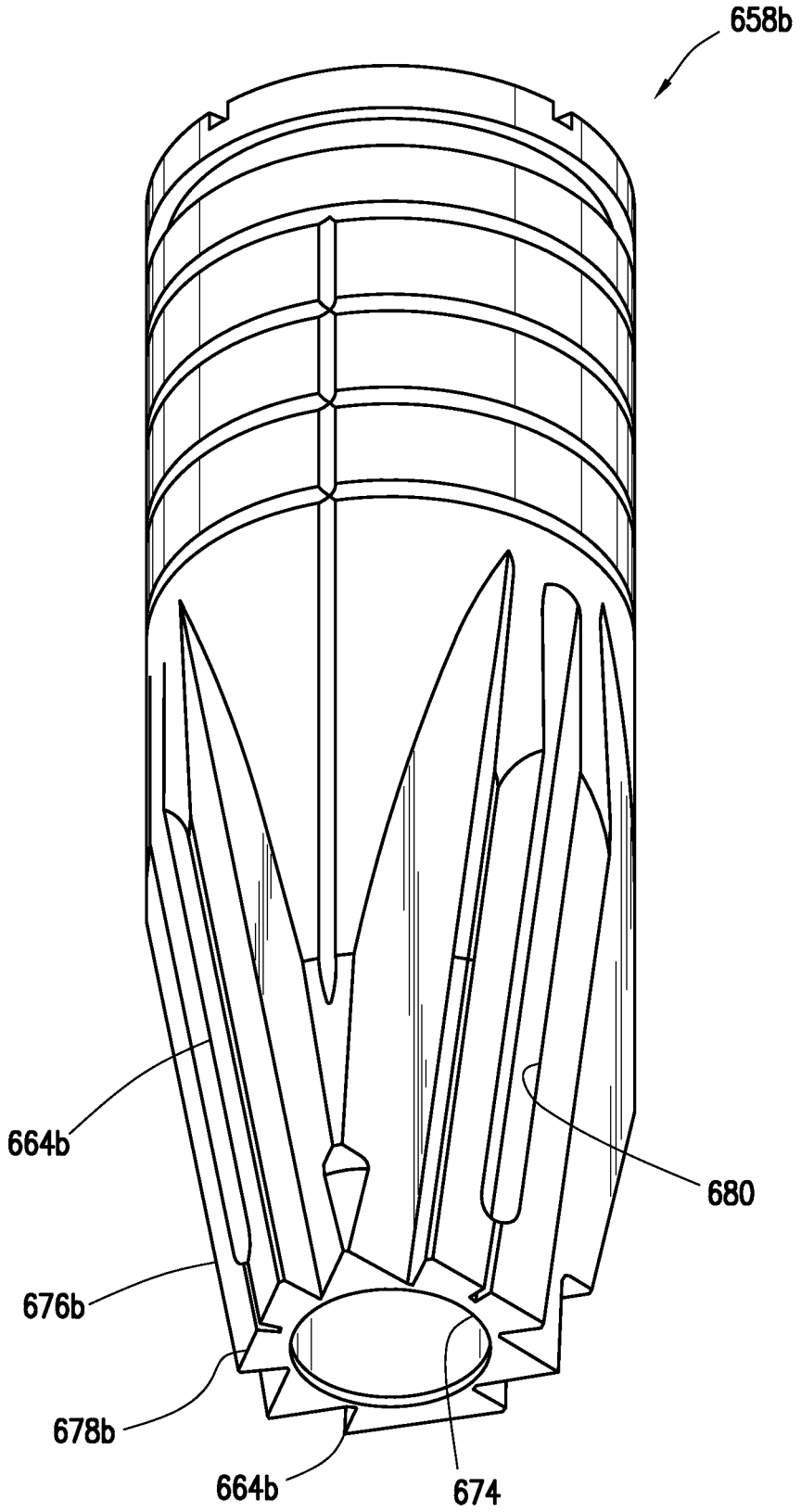

FIGS. 6A and 6B show example cam or ramp portions 658*a,b* usable as the cam portion 458 of the mandrel 446 of FIGS. 4A-5A. The cam portions 658*a,b* may be integral with the rest of the mandrel 446 or connectable thereto. The cam portions 658*a,b* have a cam passage 674 therethrough.

As shown in FIGS. 6A and 6B, the cam portion 658*a,b* has slanted cam surfaces 664*a,b* with slots 676*a,b* to slidingly engage the expanders 122. In the example shown, the cam portion 658*a,b* has a triangular body with three cam surfaces 664*a,b* thereabout. FIG. 6A shows an example slot 676*a* having a raised tongue 678*a* for receiving engagement with corresponding grooves of the expander 122. FIG. 6B shows an example slot 676*b* having a tongue 678*b* with a key 680 therein to receivingly engage the expander 122. The ends of the cam portions 658*a,b* limit the stroke of the expanders 122.

Figure 7A:
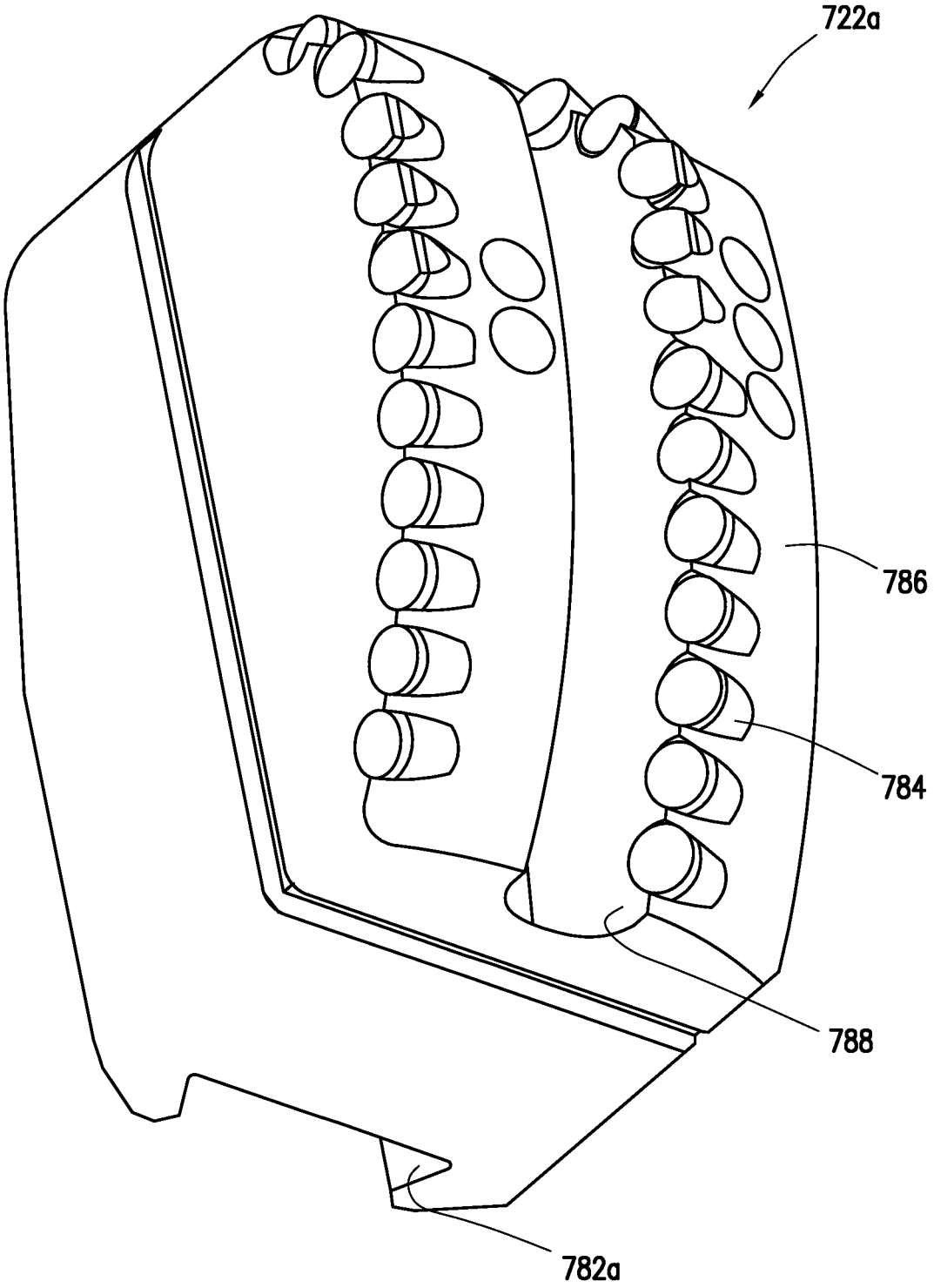
FIGS. 7A and 7B are perspective views of expanders.
Figure 7B:
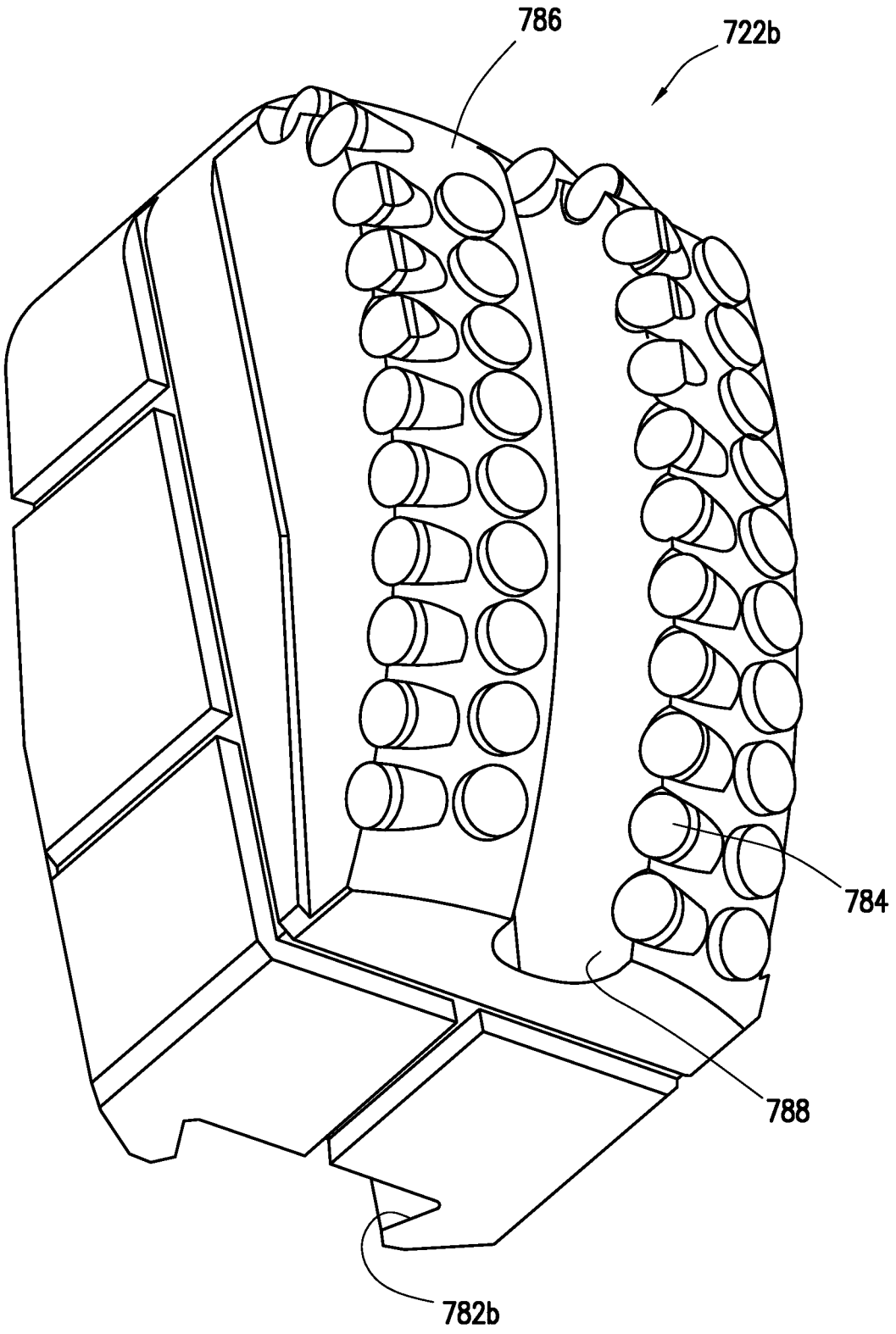

FIGS. 7A and 7B show examples of expanders 722*a,b*. Each of the expanders 722*a,b* has a groove 782*a,b* to slidingly receive the cam surfaces 464, 664*a,b* (FIGS. 4, 6A, 6B). For example, the tongues 678*a,b* are receivable in the grooves 782*a,b* to permit sliding movement of the expander 722*a,b* while retaining the expanders 722*a,b* thereon. The expanders 722*a,b* each also have cutting elements 784 on an outer surface 786 thereof for cuttingly engaging the wall of the wellbore 106 (FIG. 1).

The outer surface 786 is curved with a channel 788 therethrough. The cutting elements 784 are arranged in a linear pattern along the outer surface 786. Some of the cutting elements 784 are on a top portion of the outer surface 786 and some of the cutting elements 784 are on a side portion of the outer surface 786. The cutting elements 784 may be arranged in various patterns along the outer surface to facilitate drilling.

Figure 8:
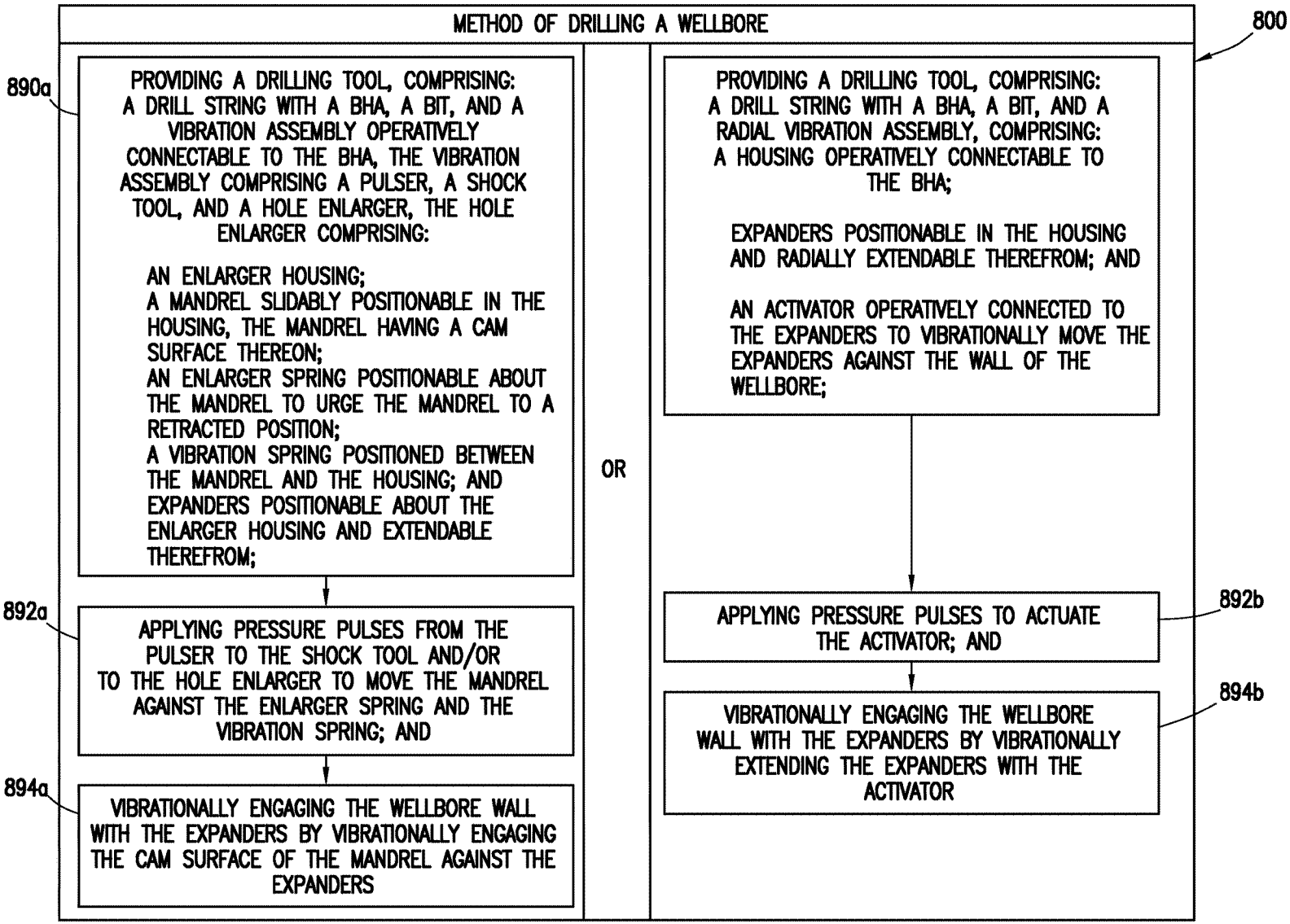
FIG. 8 is a flow chart depicting a method of drilling a wellbore.

FIG. 8 depicts a method 800 of drilling a wellbore. The method 800 involves providing a drilling tool 890*a* or 890*b*. The providing 890*a* employs a drilling tool comprising: a drill string with a BHA, a bit, and a vibration assembly operatively connectable to the BHA. The vibration assembly comprises a pulser, a shock tool, and a hole enlarger. The hole enlarger comprises an enlarger housing, a mandrel slidably positionable in the housing, the mandrel having a cam surface thereon, an enlarger spring positionable about the mandrel to urge the mandrel to a retracted position, a vibration spring positioned between the mandrel and the housing, and expanders positionable about the enlarger housing and extendable therefrom.

The providing 890*b* employs a drilling tool, comprising: a drill string with a BHA, a bit, and a radial vibration assembly. The vibration assembly comprises a housing operatively connectable to the BHA, expanders positionable in the housing and radially extendable therefrom, and an activator operatively connected to the expanders to vibrationally move the expanders against the wall of the wellbore The method further involves 892*a*—applying pressure pulses from the pulser to the shock tool and/or the hole enlarger to move the mandrel against the enlarger spring and the vibration spring, or 892*b* applying pressure pulses to actuate the activator. The method still further involves 894*a,b*—vibrationally engaging the wellbore wall. The vibrationally engaging 894*a* may be performed with the expanders by vibrationally engaging the cam surface of the mandrel against the expander(s). The vibrationally engaging 894*b* may be performed with the expanders by vibrationally extending the expander(s) with the activator.

The method(s) may be performed in any order and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more drilling assemblies in one or more locations with one more BHA components, such as hole enlargers, shock tools, and/or pulsers, in various combinations may be provided. In another example, the expanders may be vibrationally extended by any device, such as the pulser, mandrel of the hole enlarger, and/or activator. The orientation of the various components and/or assemblies may be altered or inverted.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A vibration assembly of a downhole drilling tool for drilling a wellbore penetrating a subterranean formation, the downhole drilling tool comprising a drill string, a bottomhole assembly and a drill bit, the vibration assembly comprising:

a housing operatively connectable to the bottomhole assembly;

expanders positionable in the housing and radially extendable and retractable thereabout; and a radial vibrator operatively connectable to the expanders to vibrationally move the expanders against a wall of the wellbore whereby movement of the downhole drilling tool is altered during drilling;

wherein the radial vibrator comprises a mandrel slidably positionable in the housing, the mandrel having a plurality of ramp surfaces thereon to slidably engage outer surfaces of the expanders and actuate the expanders from a retracted position to an extended position in response to relative axial movement between the mandrel and the expanders, and wherein rotation between the ramp surfaces and the expanders is restricted.

2. The vibration assembly of claim 1, wherein the radial vibrator comprises one of hydraulics, an electronic power supply, a mechanical actuator, and combinations thereof.

3. The vibration assembly of claim 1, wherein the vibration assembly further comprises a vibration spring operatively connectable to the mandrel to generate pulsing movement thereof.

4. The vibration assembly of claim 3, wherein:

the vibration spring is positioned between the mandrel and the housing; and the vibration spring comprises a Bellville spring.

5. The vibration assembly of claim 3, further comprising:

a mandrel spring thereabout to urge the mandrel to a retracted position; and seals disposed between the mandrel and the housing;

wherein the mandrel comprises a ramp portion having the ramp surfaces thereon, a spring portion having the mandrel spring thereabout, and a support portion slidingly supported in the housing.

6. The vibration assembly of claim 1, wherein:

the housing comprises one of a reamer housing, a drill collar, a drill pipe, a stabilizer, and a drill bit;

the expanders are one of cutting blocks, and pads; and the expanders are positioned in one of the bottomhole assembly, the drill bit, and combinations thereof.

7. The vibration assembly of claim 1, wherein the expanders are extendable about the housing to centralize the bottomhole assembly in the wellbore.

8. The vibration assembly of claim 1, further comprising:

at least one shock tool positionable in the bottomhole assembly to convert pressure pulses into mechanical vibration, the at least one shock tool comprising a spring loaded mandrel; and an axial pulser positionable in the bottomhole assembly, the axial pulser comprising a valve to generate the pressure pulses of a fluid passing therethrough;

wherein the housing is operatively connectable to the at least one shock tool and the axial pulser uphole from the axial pulser whereby pressure pulses are generated about the drilling tool during drilling.

9. The vibration assembly of claim 8, wherein the at least one shock tool is positioned at one of uphole from the housing and downhole from the housing.

10. The vibration assembly of claim 8, wherein the at least one shock tool is positioned at one of uphole from the axial pulser, downhole from the axial pulser, and combinations thereof.

11. The vibration assembly of claim 8, wherein:

the vibration assembly comprises at least one of a reamer, a hole enlarger, an under reamer, a part of the bottom hole assembly and combinations thereof; and the vibration assembly further comprises a downhole unit in communication with a surface unit.

12. A drilling system for drilling a wellbore penetrating a subterranean formation, the drilling system comprising:

a downhole drilling tool comprising a drill string, a bottomhole assembly and a drill bit; and a vibration assembly operatively connectable to the downhole drilling tool, the vibration assembly comprising:

a housing operatively connectable to the bottomhole assembly;

expanders positionable in the housing and radially extendable and retractable thereabout; and a radial vibrator operatively connectable to the expanders to vibrationally move the expanders against a wall of the wellbore whereby movement of the downhole drilling tool is altered during drilling;

wherein the radial vibrator comprises a mandrel slidably positionable in the housing, the mandrel having a ramp surface thereon to engage the expanders as the mandrel moves about the housing whereby the expanders are radially extendable and retractable thereabout;

wherein the mandrel comprises a piston configured to move axially relative to the expanders in response to a flow of fluid through a central passage of the mandrel whereby the expanders are radially extendable and retractable;

a pulser operatively connectable to the bottomhole assembly and configured to generate pressure pulses to axially displace the mandrel relative to the expanders.

13. The drilling system of claim 12, further comprising an axial assembly operatively connectable to the bottomhole assembly, and wherein the axial assembly comprises at least one of a shock tool and a hole enlarger.

14. The drilling system of claim 13, wherein:

the pulser is downhole from the hole enlarger;

the pulser comprises a valve and nozzles; and the drilling system further comprises at least one controller.

15. The drilling system of claim 13, wherein:

the shock tool is one of above the hole enlarger, below the pulser, and between the hole enlarger and the pulser; and the hole enlarger comprises one of a reamer, a hole enlarger, an under reamer, and combinations thereof.

16. A method of drilling a wellbore penetrating a subterranean formation, the method comprising:

advancing a drilling tool into the formation, the drilling tool comprising a drill string, a bottomhole assembly, a drill bit, and a vibration assembly, the vibration assembly comprising expanders;

vibrating the expanders against a wall of the wellbore by repeatedly extending and retracting the expanders during drilling;

flowing a fluid through a central passage of a mandrel slidably positionable in a housing to move a piston of the mandrel axially relative to the expanders; and applying pressure pulses from a pulser to the mandrel to axially displace the mandrel relative to the expanders;

wherein the vibrating comprises selectively extending the expanders by moving the piston axially relative to the expanders and engaging a ramp surface of the mandrel with the expanders.

17. The method of claim 16, further comprising:

expanding the wellbore with a hole opener;

applying fluid to a wall of the wellbore before the expanding; and axially pulsing and/or axially shocking the bottomhole assembly.

18. The method of claim 16, wherein:

the vibrating comprises repeatedly extending the expanders from the bottomhole assembly and/or the drill bit;

the vibrating further comprises offsetting at least one of stick slip, vibration, and whirl of the drilling tool.

19. The method of claim 16, further comprising:

applying pressure pulses to actuate an activator of the vibration assembly that is operatively connected to the expanders; and vibrationally engaging the wall of the wellbore with the expanders by vibrationally extending the expanders with the activator.

20. The method of claim 16, further comprising:

applying pressure pulses from the pulser to a shock tool and/or to a hole enlarger to move the mandrel against an enlarger spring and a vibration spring; and vibrationally engaging the wall of the wellbore with the expanders by vibrationally engaging the ramp surface of the mandrel against the expanders.

* * * * *